US005391102A

United States Patent [19]

Bosch

[11] Patent Number: 5,391,102

[45] Date of Patent: Feb. 21, 1995

[54] SPARKING TOY VEHICLE

[75] Inventor: Warren E. Bosch, Burlington, N.J.

[73] Assignee: Matchbox Toys (U.S.A.) Limited, Mount Laurel, N.J.

[21] Appl. No.: 164,083

[22] Filed: Dec. 8, 1993

[51] Int. Cl.[6] ..... A63H 17/045

[52] U.S. Cl. ..... 446/23

[58] Field of Search ..... 446/23, 22, 448, 449, 446/465, 466, 462

[56] References Cited

U.S. PATENT DOCUMENTS

| | | | |
|---|---|---|---|
| 361,735 | 4/1887 | Waterstraw | 446/448 |
| 1,957,687 | 5/1934 | Arnold | 446/23 |
| 2,055,848 | 9/1936 | Marx . | |
| 2,167,249 | 7/1939 | McKeige . | |
| 2,487,481 | 11/1949 | Savitt | 446/23 |
| 3,952,786 | 4/1976 | Kreling et al. | 446/465 X |
| 4,286,806 | 9/1981 | Bergstein . | |
| 4,394,037 | 7/1983 | Kuntz | 446/23 X |
| 4,490,939 | 1/1985 | Kennedy et al. | 446/448 |
| 4,516,952 | 5/1985 | Brand et al. | 446/448 X |
| 4,568,307 | 2/1986 | Gabler et al. . | |
| 4,571,212 | 2/1986 | Kakizaki | 446/23 X |
| 4,721,489 | 1/1988 | Galoob . | |
| 4,834,407 | 5/1989 | Salvo | 446/23 X |

FOREIGN PATENT DOCUMENTS

| | | | |
|---|---|---|---|
| 425917 | 3/1926 | Germany | 446/23 |
| 633241 | 7/1936 | Germany | 446/23 |
| 884769 | 7/1953 | Germany | 446/23 |
| 461687 | 8/1951 | Italy | 446/23 |
| 485775 | 5/1938 | United Kingdom | 446/23 |
| 2151147 | 7/1985 | United Kingdom | 446/23 |

*Primary Examiner*—Max Hindenburg
*Assistant Examiner*—D. Neal Muir
*Attorney, Agent, or Firm*—Panitch Schwarze Jacobs & Nadel

[57] ABSTRACT

A sparking toy vehicle for being supported on a play surface includes a vehicle body, front and rear wheels rotatably mounted on the vehicle body and a spark generating mechanism mounted on the vehicle. The at least two wheels are mounted with respect to the body for movement between a first position in which the body is a first distance from the play surface when the wheels are in engagement with the play surface and a second position in which the body is a second distance from the play surface when the wheels are in engagement with the play surface. The spark generating mechanism is spaced from the play surface when the body is in the first position and is in contact with the play surface when the body is in the second position. When the vehicle body is in the second position and the vehicle is moved across the play surface the spark generating mechanism is in rolling contact with the play surface and generates a spark.

16 Claims, 1 Drawing Sheet

SPARKING TOY VEHICLE

FIELD OF THE INVENTION

The present invention relates generally to toy vehicles and, more particularly, to a sparking toy vehicle.

BACKGROUND OF THE INVENTION

The use of non-igniting spark generating mechanisms is generally known. One such spark generating mechanism is used on a wheeled toy vehicle which includes a vehicle body having a fly-wheel mounted about a fly-wheel axle proximate to an end of the body. A pinion gear is rotatably mounted about the fly-wheel axle and is operatively connected to the fly-wheel such that rotation of the pinion gear rotates the fly-wheel. A flint holding member is mounted about a flint holding member axle which is supported within the body. A small spring is attached at one end to one end of the flint holding member and attached at its other end to the body of the vehicle. A flint is attached to the other end of the flint holding member. The spring biases the flint holding member such that the flint contacts one side of the fly-wheel. An iron based material is adhered to the side of the fly-wheel in contact with the flint, such that upon rotation of the fly-wheel sparks are ignited as a result of the friction generated between the flint and the iron based material on the side of the fly-wheel.

Another prior art spark generating mechanism includes a support bracket attached to the rear wheel assembly of a conventional roller skate. At the rear end of the support bracket, an axle carrying a grindstone wheel between two actuating wheels is mounted for rotation. The support bracket holds a flint in resilient contact with the grindstone wheel. The entire spark generating mechanism does not operate during normal skating. However, when the skater tilts the skate in a rearward direction, the actuating wheels are brought into contact with the surface on which the skater is moving causing the actuating wheels and therefore the axle and grindstone wheels to rotate in unison with the skate wheels. The sparks are generated from the frictional engagement and rubbing of the grindstone continuously rotating against the flint element until the skater lifts the actuating wheels out of contact with the surface.

Push-down actuating toy vehicles are also generally known. One prior art push-down toy vehicle is actuated by providing vertical motion between the wheels and the axles as one part, and a vehicle body as another part. A spring is provided to normally keep the vehicle body elevated with respect to the wheel axle. When a user manually grasps the toy vehicle to move it along the play surface, the user presses the vehicle downwardly, overcoming the bias of the spring. The downward movement is utilized to actuate different components of the toy vehicle.

In contrast, the concept of the combination of a spark generating mechanism with a push-down toy vehicle, and the combination of a vertical displacement of the vehicle body with respect to a play surface and with motion of the vehicle across the play surface to produce sparks, have not previously been disclosed. The present invention applies these novel concepts by providing a sparking toy vehicle including a spark generating mechanism mounted on a vehicle body which is supported by wheels rotatably mounted on the vehicle body, such that when the vehicle is simultaneously moved across the play surface and pressed downwardly toward the play surface, the spark generating mechanism produces a display of sparks. Additionally, the sparking toy vehicle of the present invention is simple in construction and operation and thus provides for extended play time of the vehicle and a long and useful life of the same.

SUMMARY OF THE INVENTION

Briefly stated, the present invention comprises a sparking toy vehicle for being supported on a play surface. The vehicle includes a vehicle body, a plurality of wheels rotatably mounted on the vehicle body, and a spark generating mechanism mounted on the vehicle. The wheels are mounted with respect to the body for movement between a first position in which the body is a first distance from the play surface when the wheels are in engagement with the play surface and a second position in which the body is a second distance from the play surface when the wheels are in engagement with the play surface, with the first distance being greater than the second distance. The spark generating mechanism is spaced from the play surface when the body is in the first position and is in contact with the play surface when the body is in the second position. When the body is in the second position and the vehicle is moved across the play surface, the spark generating mechanism is in rolling contact with the play surface and generates a spark.

BRIEF DESCRIPTION OF THE DRAWINGS

The foregoing summary, as well as the following detailed description of a preferred embodiment of the invention, will be better understood when read in conjunction with the appended drawing. For the purpose of illustrating the invention, there is shown an embodiment which is presently preferred. It being understood, however, that this invention is not limited to the precise arrangements and instrumentalities shown. In the drawing.

DETAILED DESCRIPTION OF PREFERRED EMBODIMENT

Figure 1:
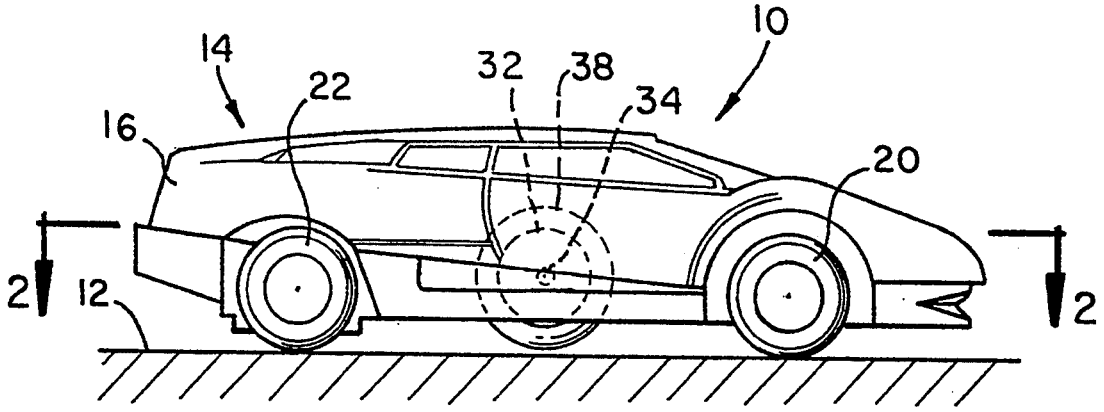
FIG. 1 is a side elevational view of a sparking toy vehicle in accordance with the present invention.
Figure 2:
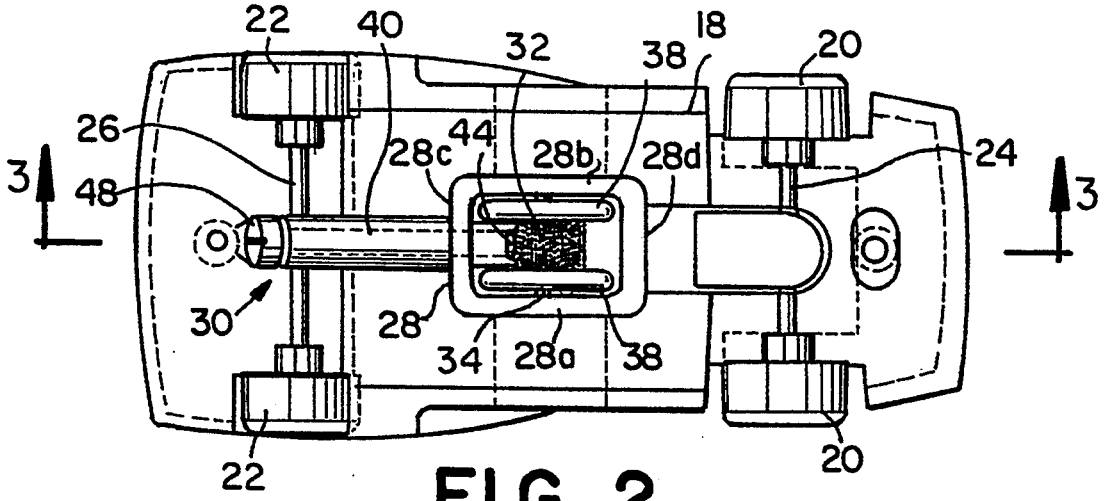
FIG. 2 is a cross-sectional view of the sparking toy vehicle shown in FIG. 1 taken along lines 2—2 of FIG. 1.
Figure 3:
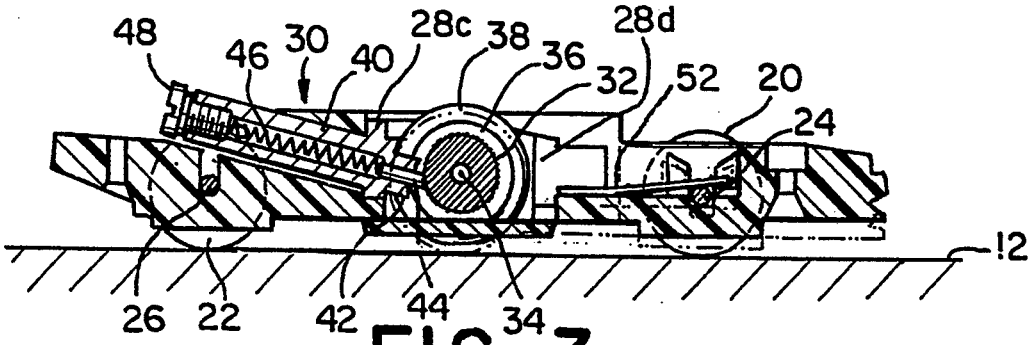
FIG. 3 is a cross-sectional view of the sparking toy vehicle shown in FIG. 2 taken along lines 3—3 of FIG. 2.

In the drawing, like numerals are used to indicate like elements throughout. A preferred embodiment of a sparking toy vehicle, generally designated 10, is shown in FIGS. 1—3 supported on a play surface 12. The play surface 12 may be a floor, sidewalk, vertical wall, etc. The vehicle 10 includes a vehicle body, generally designated at 14, in the shape of any known or unknown vehicle, comprising an upper body portion 16 and a chassis or lower body portion 18. The upper body portion 16 is preferably secured to the lower body portion 18 using conventional screw connections (not shown), for example, as disclosed in U.S. Pat. No. 4,490,939, which is incorporated by reference herein in its entirety. However, it is understood by those skilled in the art that other forms of connection between the upper body portion 16 and the lower body portion 18, such as a snap fit or an adhesive connection, are suitable.

The upper 16 and lower 18 body portions are preferably constructed of a durable material which is formable into an interesting vehicle appearance and is capable of withstanding extended play time. Accordingly, it is preferred that the upper and lower body portions 16, 18 be molded of a high strength polymeric material. However, is understood by those skilled in the art that other materials, such as zinc/magnesium or other metal alloys, and other fabrication methods, such as a metal forming process, are suitable for forming the upper and lower body portions 16, 18.

As best shown in FIGS. 2 and 3, the lower body portion 18 supports a pair of spaced apart front wheels 20 and a pair of spaced apart rear wheels 22 through respective axles 24 and 26. Centrally located on the lower body portion 18 is a housing 28 comprising a pair of generally parallel spaced side walls 28*a*, 28*b*, a rear wall 28*c* and a front wall 28*d* extending between the side walls 28*a*, 28*b*. The housing 28 contains a spark generating mechanism 30 further described below. It will be appreciated by those skilled in the art that the number and locations of the wheels 20, 22 and the shape, size and location of the housing 28 with respect to the lower body portion 18 could vary. Preferably, the housing 28 is formed or molded from a polymeric material and more preferably from the same material as previously described for the upper and lower body portions 16, 18 and the housing 28 is preferably formed integrally with the lower body portion 18. However, it is understood by those skilled in the art that other materials and fabrication methods are suitable for the 10 housing 28. Preferably, the wheels 20, 22 are formed, at least in part, of a rubber material to simulate actual vehicle tires.

Referring now to FIGS. 2 and 3, the spark generating mechanism 30 comprises a generally annular abrasive sparking wheel 32 of a type well known in the art and typically constructed from an iron based material. The sparking wheel 32 is rotatably mounted on an axle 34 which is fixedly supported to opposite inner surfaces of the sidewalls 28*a*, 28*b* of the housing 28. The sparking wheel 32 is disposed between and attached for rotation with a pair of generally annular rims 36 which are secured on each lateral side of the sparking wheel 32. The rims 36 are preferably formed of a high strength metal or metal alloy. Each of the rims 36 in turn supports a friction element 38. Preferably, each of the friction elements 38 is an O-ring constructed from an elastomeric material such as natural or synthetic rubber.

The spark generating mechanism 30 further includes a second, generally tubular housing 40 having one end which extends through an opening in the rear wall 28*c* of housing 28. Preferably, the second housing 40 extends generally upwardly and rearwardly from housing 28 at a predetermined angle, the purpose of which will hereinafter become apparent. One end of the housing 40 includes a generally circular opening 42 which is sized and shaped to receive a spark producing element 44 typically in the form of a generally cylindrical flint. The flint 44 is of a type generally well known in the spark producing art and need not be discussed in greater detail for a complete understanding of the present invention. A biasing member, in the present embodiment, a steel coil spring 46, is also located within the housing 40. A first end of the spring 46 engages one end of the flint 44 in the manner illustrated in FIG. 3. The other end of the spring 46 engages a removable member 48 installed within the other end of the housing 40. In the presently preferred embodiment, the removable member 48 comprises a threaded screw-like member or screw which threadingly engages with suitable threading on the interior surface of housing 40 to hold the screw 48 in place. The length of the screw 48 and the length and size of the spring 46 are selected so that when the spring 46 is installed within housing 40 and the screw 48 is in place, sufficient pressure is put upon the spring 46 to bias the flint 44 to extend at least slightly out of the housing opening 42 and into positive engagement with the sparking wheel 32 as shown on FIG. 3. As the sparking wheel 32 is rotated, the interaction of the sparking wheel 32 with the flint 44 results in the generation of sparks in a manner well known in the art. The use of the screw 48 and spring 46 permits removal and replacement of the flint 44 as required.

Preferably, the housing 40 is formed of the same material as the upper and lower body portions 16, 18. However, it will be appreciated by those skilled in the art that the housing 40 could be formed of any other suitable material and that the housing 40 may be of some other shape suitable for maintaining the spark producing element or flint 44 in suitable engagement with the sparking wheel 32. It will also be appreciated by those skilled in the art that while in the present embodiment, the flint 44 is replaceable by removing the screw 48 from the housing, removing the spring 46 and inserting a new flint, if desired, the end of the housing 40 distal from the flint 44 may be sealed thereby permitting placement of the flint only upon removal of the housing 40 from the rear wall 28*c* of housing 28. Alternatively, a non-replaceable flint arrangement may be employed, if desired.

As best shown in FIG. 3, when the toy vehicle 10 is placed on a play surface, there is sufficient clearance between the play surface 12 and the friction elements 38 to permit movement of the toy vehicle 10 without the generation of sparks. The front axle 24 is movably supported within a pair of elongated slots 50 (only one slot shown in FIG. 3) to permit movement of the axle 24 and the front wheels 20 with respect to the lower body portion 18. A resilient biasing member 52 is employed for biasing the axle and thus the wheels away from the lower body portion 18 in order to maintain the toy vehicle 10 in the position shown in FIG. 1 with the friction elements 38 spaced from the play surface 12. In the presently preferred embodiment, the resilient biasing member 52 is in the form of a leaf-type spring, one end of which is secured to the lower body portion 18, and the other end of which engages the axle 24 to bias the axle 24 and, thus the front wheels 20, downwardly when viewing FIG. 3. The leaf spring 52 may be formed of a metallic material or any other suitable generally resilient material known to those skilled in the art. The biasing member 52 may be secured to the lower body portion utilizing an adhesive material, a pin connection, or in any other suitable manner.

Referring now to FIG. 3, there is illustrated in phantom a feature of the present invention in which the vehicle body 14 is a second distance from the play surface 12. In the second position, the spark generating mechanism 30, specifically the friction elements 38, is in contact with the play surface 12.

The front wheels 20 are movable from the first position in which the body 14 is at the first distance from the play surface 12 (FIG. 1) to the second position (FIG. 3 in phantom) in which the body 14 is at the second distance from the play surface 12 by a user manually pressing downwardly on at least the front end of the vehicle body 14 to overcome the bias of the resilient biasing member 52 that keeps the vehicle body 14 at the first distance 46 from the play surface 12. It will be apparent to those of ordinary skill in the art that the strength of the resilient biasing member 52 should be such that it can be easily overcome by a person using the sparking toy vehicle 10 by merely pressing downwardly on at least the front end of the sparking vehicle 10 to place the body 14 at the second distance from the play surface 12. Accordingly, when the vehicle body 14 is at the second distance from the play surface 12 and the sparking toy vehicle 10 is moved or rolled across the play surface 12, the spark generating mechanism 30, specifically the O-ring friction elements 38 on the rims 36, are in rolling contact with the play surface and rotate the sparking wheel 32. The flint 44 is in contact with the sparking wheel 32 under the bias of the resilient biasing member 46 to generate sparks which illuminate the vehicle body 14.

The upper and lower body portions 16, 18 define a vehicle body 14 which is generally hollow in construction when connected together in the manner disclosed in U.S. Pat. No. 4,490,939. At least a portion of either or both of the upper and lower body portions 16, 18 is preferably molded from a transparent or translucent synthetic plastic material such as Acrylic, SAN, Clear ABS, Polycarbonate or Crystal Styrene. The generally hollow construction of the vehicle body 14 defines a light emitting area which is illuminated to create a spectacular display of sparking lights when the vehicle body 14 is at the second distance from the play surface 12 and the vehicle 10 is rolled across the play surface 12 with the spark generating mechanism 30 being in rolling contact with the play surface 12. However, it is understood by those skilled in the art that other types of transparent or translucent materials which can display the sparks generated by the spark generating mechanism 30 are suitable.

The toy vehicle 10 of the present invention can function in one of two manners. In the first manner, the vehicle body 14 is positioned with the spark generating mechanism 30 spaced from the play surface 12 such that the toy vehicle 10 becomes a freewheeling high speed vehicle. In the second manner, the spark generating mechanism 30 is in contact with the play surface 12 and the toy vehicle 10 is no longer freewheeling and can be used as a sparking vehicle. It is the dual nature of the toy vehicle 10 which increases its play value.

From the foregoing description in can be seen that the present invention comprises an improved sparking toy vehicle for being supported on a play surface. It will be appreciated by those skilled in the art, that changes could be made to the embodiments described in the foregoing description without departing from the broad inventive concept thereof. For example, the housing 28 could alternatively be formed integrally with the upper body portion 16 and the lower body portion 18 could be formed with an opening permitting the spark generating mechanism 30 to contact the play surface 12 when the vehicle body 14 is at the second distance from the play surface 12. It is understood, therefore, that this invention is not limited to the particular embodiment disclosed, but it is intended to cover all modifications which are in the scope and spirit of the invention as defined by the appended claims.

I claim:

1. A sparking toy vehicle for being supported on a play surface, said vehicle comprising:

(a) a vehicle body;

(b) a plurality of wheels rotatably mounted on said vehicle body said wheels being mounted with respect to said body for movement between a first position in which said body is a first distance from the play surface when the wheels are in engagement with the play surface and a second position in which said body is a second distance from the play surface when the wheels are in engagement with the play surface, said first distance being greater than said second distance;

(c) a spark generating mechanism mounted on said body, said spark generating mechanism being spaced from the play surface when said body is in said first position and in contact with the play surface when said body is in said second position, said spark generating mechanism comprising:

(i) a sparking wheel rotatably mounted on said body; and (ii) a spark-producing element in contact with said sparking wheel such that upon rotation of said sparking wheel a spark is produced whereby when said body is in said second position and the vehicle is moved across the play surface said spark generating mechanism is in rolling contact with the play surface and said spark generating mechanism generates a spark.

2. A sparking toy vehicle as set forth in claim 1 further comprising a resilient biasing member interconnected between at least two of said wheels and said body, said biasing member biasing said wheels to said first position.

3. A sparking toy vehicle as set forth in claim 1, wherein at least a portion of said vehicle body is made of a transparent or translucent material.

4. A sparking toy vehicle as set forth in claim 3, wherein said transparent or translucent material is selected from the group consisting of acrylic, SAN, clear ABS, Polycarbonate and Crystal Styrene.

5. A sparking toy vehicle as set forth in claim 1 further comprising a biasing member biasing said spark-producing element into contact with said sparking wheel.

6. A sparking toy vehicle as set forth in claim 1, wherein said sparking wheel further comprises a friction element extending outwardly from said sparking wheel, said friction element being in frictional contact with the play surface when said body is in said second position.

7. A sparking toy vehicle as set forth in claim 6, wherein said friction element comprises an O-ring.

8. A sparking toy vehicle as set forth in claim 1, wherein said spark-producing element comprises a flint.

9. A sparking toy vehicle for being supported on a play surface, said vehicle comprising:

(a) a vehicle body;

(b) a plurality of wheels rotatably mounted on said vehicle body, said wheels being mounted with respect to said body for movement between a first position in which said body is a first distance from the play surface when the wheels are in engagement with the play surface and a second position in which said body is a second distance from the play surface when the wheels are in engagement with the play surface, said first distance being greater than said second distance;

(c) a sparking wheel rotatably mounted on said body and being spaced from the play surface when said body is in said first position and in contact with the play surface when said body is in said second position; and (d) a spark-producing element in contact with said sparking wheel such that upon rotation of said sparking wheel a spark is produced, whereby when said body is in said second position and the vehicle is moved across the play surface said spark generating mechanism is in rolling contact with the play surface and said spark generating mechanism generates a spark.

10. A sparking toy vehicle as set forth in claim 9 further comprising a resilient biasing member interconnected between at least two of said wheels and said body, said biasing member biasing said wheels to said first position.

11. A sparking toy vehicle as set forth in claim 9, wherein said sparking wheel comprises a friction element extending outwardly from said sparking wheel, said friction element being in frictional contact with the play surface when said body is in said second position.

12. A sparking toy vehicle as set forth in claim 11, wherein said friction element comprises an O-ring.

13. A sparking toy vehicle as set forth in claim 9 further comprising a biasing member biasing said spark-producing element into contact with said sparking wheel.

14. A sparking toy vehicle as set forth in claim 9, wherein said spark-producing element comprises a flint.

15. A sparking toy vehicle as set forth in claim 9, wherein at least a portion of said vehicle body is made of a transparent or translucent material.

16. A sparking vehicle as set forth in claim 15, wherein said transparent or translucent material is selected from the group consisting of Acrylic, SAN, Clear ABS, Polycarbonate and Crystal Styrene.

* * * * *